US009575427B2

(12) United States Patent
Urabe et al.

(10) Patent No.: US 9,575,427 B2
(45) Date of Patent: Feb. 21, 2017

(54) TONER CONTAINING CRYSTALLINE POLYESTER RESIN AND METHOD OF MANUFACTURING THE SAME

(71) Applicants: KABUSHIKI KAISHA TOSHIBA, Tokyo (JP); TOSHIBA TEC KABUSHIKI KAISHA, Tokyo (JP)

(72) Inventors: Takashi Urabe, Sunto Shizuoka (JP); Taishi Takano, Sunto Shizuoka (JP); Satoshi Araki, Mishima Shizuoka (JP); Junichi Ishikawa, Mishima Shizuoka (JP); Maiko Yoshida, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/800,192

(22) Filed: Jul. 15, 2015

(65) Prior Publication Data

US 2017/0017172 A1 Jan. 19, 2017

(51) Int. Cl.

| | |
|---|---|
| ***G03G 9/08*** | (2006.01) |
| ***G03G 9/087*** | (2006.01) |
| ***G03G 15/08*** | (2006.01) |

(52) U.S. Cl.
CPC ..... *G03G 9/08755* (2013.01); *G03G 9/081* (2013.01); *G03G 9/08797* (2013.01); *G03G 15/0865* (2013.01)

(58) Field of Classification Search
CPC . G03G 9/08755; G03G 9/08797; G03G 9/081
USPC ..... 430/109.4
See application file for complete search history.

(56) References Cited

U.S. PATENT DOCUMENTS

| | | | | |
|---|---|---|---|---|
| 8,778,588 | B2 * | 7/2014 | Kusahara | G03G 9/08755 399/252 |
| 9,057,971 | B2 * | 6/2015 | Watanabe | G03G 9/0802 |
| 2012/0196218 | A1 * | 8/2012 | Hong | G03G 9/0804 430/105 |

* cited by examiner

*Primary Examiner* — Mark A Chapman
(74) *Attorney, Agent, or Firm* — Patterson Sheridan, LLP

(57) ABSTRACT

A toner includes a crystalline polyester resin in an amount equal to or greater than 25% by mass. The toner satisfies the following formula when the toner is tested using a capillary rheometry measurement during which a pellet of the toner is pressed by a member while being heated: 0.3≤(first temperature−second temperature)/(second temperature−third temperature)≤1, where the first temperature is a temperature at which the member falls 4 mm, the second temperature is a temperature at which the member falls 2 mm, and the third temperature is a temperature at which the member starts to fall.

16 Claims, 4 Drawing Sheets

FIG. 4

| | CONTENT IN TONER | | | CROSS LINKING PROMOTION STEP | FLOW TESTER MEASUREMENT | | | | IMAGE FORMING | | | STORAGE STABILITY OF TONER | GLOSSINESS OF IMAGE |
|---|---|---|---|---|---|---|---|---|---|---|---|---|---|
| | CRYSTALLINE POLYESTER RESIN (% BY MASS) | AMORPHOUS POLYESTER RESIN (% BY MASS) | CROSS-LINKING AGENT (% BY MASS) | STIRRING TIME AT 72°C (TIME) | OUTFLOW START TEMPERATURE $T_0$ (°C) | 2 MM FALL TEMPERATURE $T_{2MM}$ (°C) | 4 MM FALL TEMPERATURE $T_{4MM}$ (°C) | $(T_{4mm}-T_{2mm})/(T_{2mm}-T_0)$ | LOWEST FIXATION TEMPERATURE (°C) | HIGHEST FIXATION TEMPERATURE (°C) | TEMPERATURE RANGE FOR FIXING (°C) | UPPER LIMIT TEMPERATURE FOR STORAGE (°C) | |
| EXAMPLE 1 | 71 | 14 | 4 | 2 | 73.2 | 108.7 | 127.0 | 0.52 | 95 | 180 | 85 | 60 | 6 |
| EXAMPLE 2 | 47 | 38 | 4 | 2 | 71.2 | 109.4 | 128.0 | 0.49 | 100 | 180 | 80 | 58 | 9 |
| EXAMPLE 3 | 28 | 57 | 4 | 2 | 68.4 | 111.2 | 130.6 | 0.45 | 110 | 180 | 70 | 57 | 13 |
| EXAMPLE 4 | 48 | 38 | 2 | 2 | 70.9 | 86.7 | 92.7 | 0.38 | 100 | 160 | 60 | 58 | 15 |
| EXAMPLE 5 | 49 | 39 | 1 | 2 | 70.4 | 82.9 | 86.7 | 0.30 | 100 | 140 | 40 | 58 | 18 |
| EXAMPLE 6 | 48 | 38 | 2 | 1 | 70.5 | 80.4 | 83.4 | 0.30 | 100 | 140 | 40 | 58 | 18 |
| EXAMPLE 7 | 70 | 14 | 5 | 0 | 73.5 | 115.7 | 148.2 | 0.77 | 100 | 200 | 100 | 60 | 2 |
| COMPARATIVE EXAMPLE 1 | 74 | 15 | 0 | 2 | 71.2 | 78.9 | 80.1 | 0.16 | 95 | 95 | 0 | 60 | 7 |
| COMPARATIVE EXAMPLE 2 | 24 | 61 | 4 | 2 | 66.9 | 112.9 | 131.0 | 0.39 | 115 | 180 | 65 | 55 | 16 |
| COMPARATIVE EXAMPLE 3 | 71 | 14 | 4 | 0 | 72.8 | 79.6 | 81.0 | 0.21 | 95 | 105 | 10 | 60 | 20 |

TONER CONTAINING CRYSTALLINE POLYESTER RESIN AND METHOD OF MANUFACTURING THE SAME

FIELD

Embodiments described herein relate generally to a toner containing a crystalline polyester resin and a method of manufacturing the same.

BACKGROUND

A toner is used to form an image on a medium. A toner that can be fixed at a low temperature is preferred because the energy used for fixing the toner would be reduced.

A toner of one type in the related art includes a binder resin that has a low glass transition temperature. This toner has a low fixing temperature, but may be solidified while being stored in a toner cartridge.

A toner of another type includes crystalline polyester resin to further lower the fixing temperature. However, the toner of this type may also be solidified while being stored in a toner cartridge. Further, because viscosity of this toner significantly reduces when being heated to a certain temperature, the toner may not be properly transferred to the medium because of lack of viscosity. As a result, a temperature range within which the toner can be properly transferred to the medium may become narrower.

DESCRIPTION OF THE DRAWINGS

FIG. 4 is a table illustrating evaluation of a toner according to a plurality of embodiments in comparison to comparative examples.

DETAILED DESCRIPTION

First Embodiment

Figure 1:
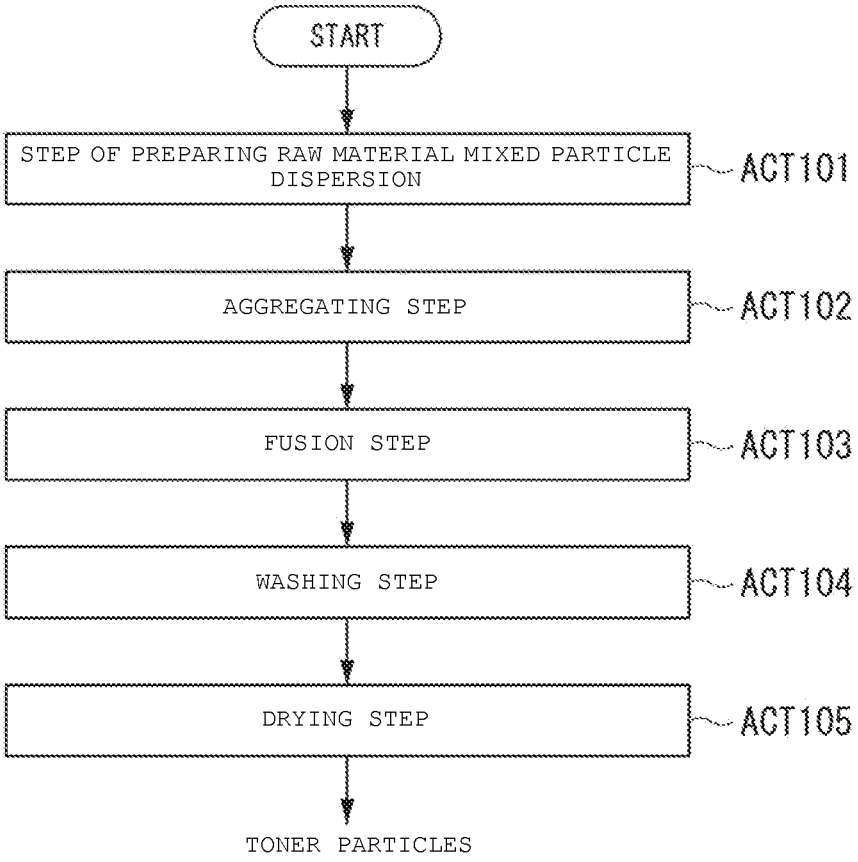
FIG. 1 is a flowchart of a toner particle preparation process according to one embodiment.

An electrophotographic toner according to a first embodiment includes a crystalline polyester resin in an amount equal to or greater than 25% by mass. In addition, the electrophotographic toner satisfies a relationship of the following expression (1) when the toner is tested using a flow tester measurement (capillary rheometry measurement).

$$0.3 \leq (\text{4 mm fall temperature} - \text{2 mm fall temperature})/(\text{2 mm fall temperature} - \text{outflow start temperature}) \leq 1 \quad \text{Expression (1)}$$

Hereinafter, the electrophotographic toner according to the embodiment will be described. The electrophotographic toner according to the embodiment contains a crystalline polyester resin. As the crystalline polyester resin, a polycondensation product of polyol and polycarboxylic acid may be used, and a polycondensation product of diol and dicarboxylic acid is preferable.

Examples of diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetra-decanediol, 1,18-octadecanediol, and 1,20-eicosanediol.

Examples of dicarboxylic acid include terephthalic acid, isophthalic acid, orthophthalic acid, t-butyl isophthalic acid, 2,6-naphthalene dicarboxylic acid, 4,4'-biphenyl dicarboxylic acid, fumaric acid, adipic acid, sebacic acid, 1,10-decane dicarboxylic acid, and 1,12-dodecane dicarboxylic acid.

A melting point of the crystalline polyester resin is appropriately determined based on a fixation temperature at which an image of the toner is formed. The melting point of the crystalline polyester resin is preferably equal to or lower than 130° C. and more preferably from 65° C. to 110° C. In the present disclosure, the melting point of the resin is a value which is measured based on differential scanning calorimetry (DSC).

One kind of the crystalline polyester resin or combination of two or more kinds of the crystalline polyester resin may be used.

A content of the crystalline polyester resin is equal to or greater than 25% by mass is preferably from 40% by mass to 90% by mass, more preferably from 45% by mass to 85% by mass, and even more preferably from 50% by mass to 80% by mass, with respect to the total amount of the toner (100% by mass).

When the content of the crystalline polyester resin is equal to or greater than the lower limit value of the range described above, the toner is likely to be fixed at a lower fixation temperature. Meanwhile, when the content of the crystalline polyester resin is equal to or smaller than the preferable upper limit value of the range described above, more excellent fixing properties are likely to be obtained and toner scattering is unlikely to occur.

In addition to the crystalline polyester resin, the electrophotographic toner according to the present embodiment may contain a binder resin excluding the crystalline polyester resin, a colorant, wax, a cross-linking agent, an aggregating agent, a charge adjusting agent, an external additive, a surfactant, a basic compound, a pH adjuster, and the like.

The binder resin excludes the crystalline polyester resin and is not particularly limited. As the binder resin, an amorphous polyester resin is preferable, in view of compatibility with the crystalline polyester resin.

In the present embodiment, a polyester resin having a ratio of a softening point to a melting temperature (softening point/melting temperature) of 0.8 to 1.2 is defined as a crystalline polyester resin, and polyester resins other than the polyester resin having the above ratio is defined as an amorphous polyester resin.

For example, as the amorphous polyester resin, an amorphous polyester resin prepared by a method disclosed in JP-A-7-175260 may be used. In the preparation of the amorphous polyester resin, a di- or higher valent alcohol component and a di- or higher valent carboxylic acid component may be used as raw material monomers.

Examples of the divalent alcohol component include a bisphenol A alkylene oxide adduct such as polyoxypropylene (2.2)-2,2-bis(4-hydroxyphenyl) propane, polyoxypropylene (3.3)-2,2-bis(4-hydroxyphenyl) propane, polyoxyethylene (2.0)-2,2-bis(4-hydroxyphenyl) propane, polyoxypropylene (2.0)-polyoxyethylene(2.0)-2,2-bis(4-hydroxyphenyl) propane, or polyoxypropylene (6)-2,2-bis(4-hydroxyphenyl) propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A. Among these, as the divalent alcohol component, a bisphenol A alkylene oxide adduct, ethylene glycol, 1,2-propylene glycol, 1,3-propylene glycol, 1,6-hexanediol, bisphenol A, and hydrogenated bisphenol A are preferable. As a bisphenol A alkylene oxide adduct, a bisphenol A alkylene (2 or 3 carbon atoms) oxide adduct (average molar number added of 1 to 10) is preferable.

Examples of the tri- or higher valent alcohol component include sorbitol, 1,2,3,6-hexanetetrol, 1,4-sorbitan, pentaerythritol, dipentaerythritol, tripentaerythritol, 1,2,4-butane triol, 1,2,5-pentane triol, glycerol, 2-methyl propane triol, 2-methyl-1,2,4-butane triol, trimethylol ethane, trimethylol propane, and 1,3,5-trihydroxy methyl benzene. Among these, as the tri- or higher valent alcohol component, sorbitol, 1,4-sorbitan, pentaerythritol, glycerol, and trimethylol propane are preferable.

One kind of the di- or higher valent alcohol component or combination of two or more kinds thereof may be used.

Examples of the di- or higher valent carboxylic acid component include divalent or higher carboxylic acid, a carboxylic acid anhydride, and carboxylic acid ester.

Examples of the divalent carboxylic acid component include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acid such as n-dodecenyl succinic acid, alkyl succinic acid such as n-dodecyl succinic acid, an anhydride of these acids, and lower alkyl ester. Among these, as the divalent carboxylic acid component, maleic acid, fumaric acid, terephthalic acid, and alkenyl succinic acid are preferable. As alkenyl succinic acid, succinic acid substituted with an alkenyl group having 2 to 20 carbon atoms is preferable.

Examples of the tri- or higher valent carboxylic acid component include 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxy propane, 1,2,4-cyclohexane tricarboxylic acid, tetra (methylene carboxyl) methane, 1,2,7,8-octane tetracarboxylic acid, pyromellitic acid, Empol trimer acid, or an anhydride of these acids, and lower alkyl ester. Among these, as the tri- or higher valent carboxylic acid component, 1,2,4-benzene tricarboxylic acid, or an anhydride of the acid, or alkyl (1 to 12 carbon atoms) ester is preferable.

One kind of the di- or higher valent carboxylic acid component or combination of two or more kinds thereof may be used.

A glass transition temperature of the amorphous polyester resin is appropriately determined based on printing conditions and the like. The glass transition temperature of the amorphous polyester resin is preferably from 30° C. to 70° C. In the present disclosure, the glass transition temperature of the resin is a value which is measured using differential scanning calorimetry (DSC).

A weight average molecular weight (Mw) of the amorphous polyester resin is preferably equal to or smaller than 1,000,000 and more preferably from 30,000 to 100,000, in view of a fixation temperature at which the toner image is formed and heat resistance of the toner.

One kind of the amorphous polyester resin or combination of two or more kinds thereof may be used.

Content of the amorphous polyester resin is preferably equal to or smaller than 75% by mass, more preferably from 10% by mass to 60% by mass, and even more preferably from 15% by mass to 50% by mass, with respect to the total amount of the toner (100% by mass).

When the content of the amorphous polyester resin is equal to or smaller than the preferable upper limit value of the range described above, an image having a higher gloss is likely to be obtained. Meanwhile, when the content of the amorphous polyester resin is equal to or greater than the preferable lower limit value of the range described above, more excellent fixing properties and more excellent storage stability are likely to be obtained.

In preparation of the crystalline polyester resin or the amorphous polyester resin described above, an esterification catalyst may be used in order to promote polycondensation of the raw material monomers. As the esterification catalyst, dibutyltin oxide or the like may be used.

A combination ratio of the crystalline polyester resin (crystalline PES) to the amorphous polyester resin (amorphous PES) is a mass ratio represented as crystalline PES/amorphous PES, and is preferably from 0.3 to 8, more preferably from 0.8 to 7, and even more preferably from 1 to 6.

When the ratio of crystalline PES/amorphous PES is equal to or greater than the preferable lower limit of the range described above, the toner is likely to be fixed at a lower fixation temperature. In addition, an image having a higher gloss is likely to be obtained. Meanwhile, when the ratio is equal to or lower than the preferable upper limit value of the range described above, more excellent fixing properties and more excellent storage stability are likely to be obtained.

Examples of the colorant include carbon black and organic or inorganic pigments and dyes.

Examples of carbon black include acetylene black, furnace black, thermal black, channel black, and Ketjen black.

Examples of the pigments and dyes include Fast Yellow G, benzidine yellow, India Fast Orange, Irgazin Red, naphthol azo, Carmine FB, permanent Bordeaux FRR, Pigment Orange R, lithol Red 2G, Lake Red C, rhodamine FB, rhodamine B lake, phthalocyanine blue, Pigment Blue, Brilliant Green B, phthalocyanine green, and quinacridone.

Examples of a preferable yellow pigment include C.I. Pigment yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185; and C.I. Vat Yellow 1, 3, and 20.

Examples of a preferable magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C.I. Pigment Violet 19; and C.I. Vat Red 1, 2, 10, 13, 15, 23, 29, and 35.

Examples of a preferable cyan pigment include C.I. Pigment Blue 2, 3, 15, 16, and 17; C.I. Vat Blue 6; and C.I. Acid Blue 45.

One kind of the colorant or combination of two or more kinds thereof may be used.

Content of the colorant is preferably from 2% by mass to 10% by mass and more preferably from 3% by mass to 8% by mass, with respect to the total amount of the toner (100% by mass).

Examples of wax include aliphatic hydrocarbon-based wax such as low molecular weight polyethylene, low molecular weight polypropylene, a polyolefin copolymer, polyolefin wax, microcrystalline wax, paraffin wax, or Fischer-Tropsch wax, an oxide of aliphatic hydrocarbon-based wax such as oxidized polyethylene wax; a block copolymer thereof; vegetable wax such as candelilla wax, carnauba wax, Japan wax, jojoba wax, or rice wax, animal wax such as beeswax, lanolin, or spermaceti; mineral wax such as ozocerite, ceresin, or petrolatum; wax including aliphatic ester as a main component such as montanic acid ester wax, or castor wax; a material obtained by deoxidizing a part of or entire aliphatic ester such as deoxidized carnauba wax; saturated straight chain fatty acids such as palmitic acid, stearic acid, montanic acid, or long-chain alkyl carboxylic acid including a long-chain alkyl group; unsaturated fatty acid such as brassidic acid, eleostearic acid, or parinaric acid; saturated alcohol such as stearyl alcohol, eicosyl alcohol, behenyl alcohol, carnaubyl Bill alcohol, ceryl alcohol, melissyl alcohol, or long-chain alkyl alcohol including a long-chain alkyl group; polyhydric alcohol such as sorbitol; fatty acid amide such as linoleic acid amide, oleic acid amide, or lauric acid amide; saturated fatty acid bisamide such as methylene-bis-stearic acid amide, ethylene-bis-capric acid amide, ethylene-bis-lauric acid amide, or hexamethylene bis-stearic acid amide; unsaturated fatty acid amides such as ethylene-bis-oleic acid amide, hexamethylene bis-oleic acid amide, N,N'-dioleyl adipic acid amide, or N,N'-dioleyl sebacic acid amide; aromatic bisamides such as m-xylene-bis-stearic acid amide, or N,N'-distearyl isophthalic acid amide; fatty acid metal salt (generally so-called metal soap) such as calcium stearate, calcium laurate, zinc stearate, or magnesium stearate; wax obtained by grafting aliphatic hydrocarbon-based wax using a vinyl-based monomer such as styrene or acrylic acid; partially esterified material of fatty acid and polyhydric alcohol such as behenic acid monoglyceride; and a methyl ester compound including a hydroxy group, which is obtained by hydrogenation of vegetable oil.

One kind of the wax or combination of two or more kinds thereof may be used.

Content of the wax is preferably from 2% by mass to 15% by mass and more preferably from 4% by mass to 12% by mass, with respect to the total amount of the toner (100% by mass).

The cross-linking agent is not particularly limited as long as the cross-linking agent reacts with carboxylic group in an aqueous medium. Examples of the cross-linking agent include a material including a carbodiimide group (—N═C═N—) and a material including an oxazoline group.

For example, as the material including a carbodiimide group, CARBODILITE V-02, V-02-L2, SV-02, or V-04 (aqueous solution of polycarbodiimide resin); or E-02, E-03A, or E-04 (emulsion of polycarbodiimide resin) manufactured by Nisshinbo Chemical Co., Inc. is used.

For example, as the material including an oxazoline group, EPOCROS WS-300, WS-500, or WS-700 (oxazoline group-containing water-soluble polymer); or K-2010E, K-2020E, or K-2030E (oxazoline group-containing emulsion) manufactured by Nippon Shokubai Co., Ltd. is used.

One kind of the cross-linking agent or combination of two or more kinds thereof may be used.

Content of the cross-linking agent is preferably from 0.5% by mass to 8% by mass and more preferably from 0.8% by mass to 6% by mass, with respect to the total amount of toner (100% by mass).

When the content of the cross-linking agent is within the preferable range described above, the fixing properties at a low temperature are more significantly improved and a temperature range for fixing is likely to be widened. In addition, the storage stability of the toner is also improved. When the content of the cross-linking agent is equal to or greater than the preferable lower limit value of the range described above, a temperature range for fixing is likely to be widened. Meanwhile, when the content is equal to or smaller than the preferable upper limit value of the range described above, glossiness of an image is likely to increase.

The aggregating agent is generally used in order to promote aggregation between the raw materials, when manufacturing the toner. Examples of the aggregating agent include metal salt such as sodium chloride, calcium chloride, calcium nitrate, barium chloride, magnesium chloride, zinc chloride, magnesium sulfate, aluminum chloride, aluminum sulfate, or potassium aluminum sulfate; nonmetal salt such as ammonium chloride or ammonium sulfate; an inorganic metal salt polymer such as poly aluminum chloride, poly aluminum hydroxide, or calcium polysulfide; a polymer aggregating agent such as Polymethacrylic acid ester, polyacrylic acid ester, polyacrylamide, an acrylamide-sodium acrylate copolymer; a coagulating agent such as polyamine, polydiallyl ammonium halide, polydiallyl dialkyl ammonium halide, melanin formaldehyde condensates, or dicyandiamide; alcohols such as methanol, ethanol, 1-propanol, 2-propanol, 2-methyl-2-propanol, 2-methoxyethanol, 2-ethoxyethanol, or 2-butoxyethanol; an organic solvent such as acetonitrile or 1,4-dioxane; inorganic acid such as hydrochloric acid or nitric acid; and organic acid such as formic acid or acetic acid. Among these, nonmetal salt is preferable and ammonium sulfate is more preferable, in order to improve a promotion effect of aggregation.

The charge adjusting agent is used in order to adjust a frictional electrification charge amount of the toner and to increase transferability of the toner onto a recording medium such as a sheet. Examples of the charge adjusting agent include a metal-containing azo compound and a metal-containing salicylic acid derivative compound. Among the metal-containing azo compounds, a complex or complex salt including iron, cobalt, or chrome as the metal, or a mixture thereof is preferable. Among the metal-containing salicylic acid derivative compound, a complex or complex salt including zirconium, zinc, chrome, or boron as the metal, or a mixture thereof is preferable.

The external additive may be also added to the electrophotographic toner according to the present embodiment, in order to add fluidity to the toner or adjust charging properties. For example, inorganic fine particles may be used as the external additive. Examples of an inorganic material configuring the inorganic fine particles include silica, titania, alumina, strontium titanate, and tin oxide. The inorganic material may be used alone as one kind or may be used in combination of two or more kinds thereof. Among the external additives, external additives having the inorganic fine particles subjected to surface treatment by a hydrophobizing agent are preferable in a viewpoint of improvement of environmental stability. In addition, as the external additive, resin fine particles having a particle diameter equal to or smaller than 1 μm may be used in order to improve cleaning properties. As the resin configuring the resin fine particles, a styrene acrylic acid copolymer, a polymethyl methacrylate, or a melamine resin may be used.

Hereinafter, characteristics of the electrophotographic toner according to the present embodiment obtained by the flow tester measurement (capillary rheometry measurement) will be described.

The electrophotographic toner according to the embodiment has a relationship of the following expression (1) when the toner is tested using flow tester measurement.

$$0.3 \leq (4\text{ mm fall temperature} - 2\text{ mm fall temperature})/(2\text{ mm fall temperature} - \text{outflow start temperature}) \leq 1 \quad \text{Expression (1)}$$

Here, the outflow start temperature is represented as $T_0$, the 2 mm fall temperature is represented as $T_{2\ mm}$, and the 4 mm fall temperature is represented as $T_{4\ mm}$. Thus, a ratio represented as the (4 mm fall temperature−2 mm fall temperature)/(2 mm fall temperature−outflow start temperature) is also represented as a ratio $(T_{4\ mm}-T_{2\ mm})/(T_{2\ mm}-T_0)$.

The ratio $(T_{4\ mm}-T_{2\ mm})/(T_{2\ mm}-T_0)$ is from 0.3 to 1, preferably from 0.3 to 0.8, more preferably from 0.3 to 0.7, and even more preferably from 0.3 to 0.6.

When the ratio $(T_{4\ mm}-T_{2\ mm})/(T_{2\ mm}-T_0)$ is from 0.3 to 1, excellent fixing properties at a low temperature are likely to be obtained, a temperature range for fixing is likely to be widened, and excellent storage stability of the toner is likely to be obtained.

When the ratio $(T_{4\ mm}-T_{2\ mm})/(T_2-T_0)$ is equal to or greater than the lower limit value of the range described above, a temperature range for fixing is likely to be widened. Meanwhile, when the ratio is equal to or smaller than the upper limit value of the range described above, glossiness of an image is likely to increase.

The flow tester measurement is performed as follows.

First, a sample is prepared. A certain amount of a toner is pressurized at 1,000 kgf (9806.65 N) for 1 minute and a pellet-like sample is obtained.

Then, the obtained sample is added to a flow tester and preheated. A temperature of preheating is appropriately set depending on the material of the toner. For example, the temperature of preheating is 30° C. or 40° C. The preheating time is set as 300 seconds.

Next, the sample is continued to heat to 200° C. at a rate of temperature increase of 2.5° C./min, while adding a load of 10 kg by a plunger.

At that time, a temperature at which the outflow of the sample (outflow start temperature $T_0$) from a fine hole of the flow tester is started, a temperature at which a falling amount of the plunger reaches 2 mm (2 mm fall temperature $T_{2\ mm}$), and a temperature at which a falling amount of the plunger reaches 4 mm (4 mm fall temperature $T_{4\ mm}$) are respectively measured.

The outflow start temperature $T_0$ of the electrophotographic toner according to the present embodiment is preferably from 60° C. to 80° C. and more preferably from 65° C. to 75° C. When the outflow start temperature $T_0$ is equal to or higher than the preferable lower limit value of the range described above, more excellent storage stability is likely to be obtained. Meanwhile, when the outflow start temperature $T_0$ is equal to or lower than the preferable upper limit value of the range described above, excellent fixing properties at a low temperature are likely to be obtained.

The 2 mm fall temperature $T_{1\ mm}$ of the electrophotographic toner according to the present embodiment is preferably from 70° C. to 120° C. and more preferably from 75° C. to 115° C. When the 2 mm fall temperature $T_{1\ mm}$ is equal to or higher than the preferable lower limit value of the range described above, a wide offset region is likely to be ensured. Meanwhile, when the 2 mm fall temperature $T_{1\ mm}$ is equal to or lower than the preferable upper limit value of the range described above, excellent fixing properties at a low temperature are likely to be obtained.

The 4 mm fall temperature $T_{4\ mm}$ of the electrophotographic toner according to the present embodiment is preferably from 75° C. to 150° C. and more preferably from 80° C. to 135° C. When the 4 mm fall temperature $T_{4\ mm}$ is equal to or higher than the preferable lower limit value of the range described above, a wide offset region is likely to be ensured. Meanwhile, when the 4 mm fall temperature $T_{4\ mm}$ is equal to or lower than the preferable upper limit value of the range described above, excellent fixing properties at a low temperature are likely to be obtained.

A difference between the 4 mm fall temperature and the 2 mm fall temperature $(T_{4\ mm}-T_{2\ mm})$ of the electrophotographic toner according to the present embodiment is preferably from 5° C. to 35° C. and more preferably from 10° C. to 30° C. When the difference $T_{4\ mm}-T_{2\ mm}$ is equal to or greater than the preferable lower limit value of the range described above, a wide offset region is likely to be ensured. Meanwhile, when the difference $T_{4\ mm}-T_{2\ mm}$ is equal to or smaller than the preferable upper limit value of the range described above, excellent fixing properties at a low temperature are likely to be obtained.

A difference between the 2 mm fall temperature and the outflow start temperature $(T_{2\ mm}-T_0)$ of the electrophotographic toner according to the embodiment is preferably from 10° C. to 40° C., more preferably from 15° C. to 40° C., and even more preferably from 15° C. to 30° C. When the difference $T_{2\ mm}-T_0$ is equal to or greater than the preferable lower limit value of the range described above, a wide offset region is likely to be ensured. Meanwhile, when the difference $T_{2\ mm}-T_0$ is equal to or smaller than the preferable upper limit value of the range described above, excellent fixing properties at a low temperature are likely to be obtained.

For example, the ratio $(T_{4\ mm}-T_{2\ mm})/(T_{2\ mm}-T_0)$ of the electrophotographic toner can be adjusted by appropriately selecting the content of the crystalline polyester resin, the mass ratio represented as crystalline PES/amorphous PES, usage of the cross-linking agent, or reaction time when combining the cross-linking agent.

The electrophotographic toner according to the present embodiment is preferably a material with which the crystalline polyester resin is crosslinked. In the toner with which the crystalline polyester resin is crosslinked, the fixing properties at a low temperature are more significantly improved and a temperature range for fixing is likely to be widened. In addition, the storage stability of the toner is also improved.

A volume average particle diameter of the electrophotographic toner according to the present embodiment is preferably from 4 μm to 10 μm and more preferably from 4.5 μm to 8 μm. When the volume average particle diameter of the electrophotographic toner is equal to or greater than the preferable lower limit value of the range described above, the development or transfer in an electrophotographic process is likely to be controlled. Meanwhile, when the volume average particle diameter is equal to or smaller than the preferable upper limit value of the range described above, thin line reproducibility is improved and a more excellent image is likely to be obtained.

In the present disclosure, the volume average particle diameter of the particles is a value measured by a method using a laser diffraction-type particle size distribution measuring device or an electrical coulter counter method.

Since the content of the crystalline polyester resin in the electrophotographic toner according to the first embodiment is equal to or greater than 25% by mass, the toner is likely to be fixed at a lower temperature. In addition, since the ratio $(T_{4\ mm}-T_{2\ mm})/(T_{2\ mm}-T_0)$ of the electrophotographic toner is from 0.3 to 1, high temperature offset resistance is improved and a temperature range for fixing is likely to be widened. Further, in the electrophotographic toner, excellent blocking resistance and storage stability are likely to be obtained.

The content of the crystalline polyester resin in the electrophotographic toner according to the first embodiment is great as 25% by mass. According to this content, defective kneading of the raw materials may occur when manufacturing the toner by a pulverization method. The electrophotographic toner is easily manufactured by a chemical method. Among these, the preferable electrophotographic toner is a toner obtained by heating an aggregate containing the crystalline polyester resin and the cross-linking agent, generated in an aqueous medium, at an arbitrary temperature.

The electrophotographic toner according to the embodiment can be suitably used in a nonmagnetic one-component developer or a two-component developer. For example, the electrophotographic toner may be used in an image forming apparatus such as a multi function peripheral (MFP) and for the electrophotographic image forming on a recording medium. When the two-component developer is used, a usable carrier is not particularly limited and is appropriately set by a person skilled in the art.

Second Embodiment

In a second embodiment, a manufacturing method of the electrophotographic toner according to the first embodiment a second embodiment is described. The manufacturing method of the electrophotographic toner according to the present embodiment includes a toner particle preparation process of preparing toner particles containing the crystalline polyester resin.

The toner particle preparation process according to the present embodiment includes an aggregating step and a fusion step. By performing the aggregating step, an aggregate containing the crystalline polyester resin and the cross-linking agent is obtained in an aqueous medium. By performing the fusion step, the aggregate obtained through the aggregating STEP is heated at an arbitrary temperature.

Hereinafter, the toner particle preparation process according to the second embodiment will be described with reference to the drawings.

FIG. 1 is a flow chart of the toner particle preparation process according to the second embodiment. The toner particle preparation process according to the embodiment includes a step of preparing a raw material mixed particle dispersion (ACT101), an aggregating step (ACT102), a fusion step (ACT103), a washing step (ACT104), and a drying step (ACT105).

Hereinafter, the step of preparing a raw material mixed particle dispersion (ACT101) will be described.

A raw material mixed particle dispersion is prepared in advance before performing the aggregating step (ACT102) (ACT101 of FIG. 1). Raw material mixed particles dispersed in the raw material mixed particle dispersion contains the crystalline polyester resin and the cross-linking agent.

Examples of a dispersion medium of the raw material mixed particle dispersion include water and a mixed solvent of water and an organic solvent, and among these, water is preferable.

The raw material mixed particle dispersion may contain other components, in addition to the crystalline polyester resin, the cross-linking agent, and the dispersion medium. As other components, a binder resin excluding the crystalline polyester resin (amorphous polyester resin or the like), a colorant, wax, a surfactant, a basic compound, and the like are used.

For example, the raw material mixed particle dispersion is prepared by applying a mechanical shear force to a solution obtained by adding the crystalline polyester resin, the cross-linking agent, and the other components to the dispersion medium.

As a device used for applying a mechanical shear force, a mechanical shearing device without using a medium such as Ultra Turrax (manufactured by IKA Japan, K.K.), TK Auto Homo Mixer (manufactured by PRIMIX Corporation), TK Pipeline Homo Mixer (manufactured by PRIMIX Corporation), TK FILMIX (manufactured by PRIMIX Corporation), CLEARMIX (manufactured by M Technique Co., Ltd.), CLEAR SS5 (manufactured by M Technique Co., Ltd.), CAVITRON (manufactured by EUROTEC Ltd.), Fine flow mill (manufactured by pacific machinery & engineering Co., Ltd.), Microfluidizer (manufactured by Mizuho Industrial Co., Ltd.), Ultimaizer (manufactured by Sugino Machine Limited), Nanomizer (manufactured by Yoshida Kikai Co., Ltd.), Genus PY (manufactured by Hakusui Chemical Industries, Ltd.), or NANO3000 (Beryu Co., Ltd.); or a mechanical shearing device using a medium such as VISCO MILL (manufactured by Aimex Co., Ltd.), APEX MILL (manufactured by Kotobuki Kogyou Co., Ltd.), STAR MILL (manufactured by Ashizawa Finetech Co., Ltd.), DCP SUPERFLOW (manufactured by Nippon Eirich Co., Ltd.), MP MILL (manufactured by Inoue MFG., INC.), SPIKE MILL (manufactured by Inoue MFG., INC.), MIGHTY MILL (manufactured by Inoue MFG., INC.), or SC MILL (manufactured by Mitsui Mining Co., Ltd.) is used.

Concentration of the raw material mixed particles in the raw material mixed particle dispersion is preferably from 20% by mass to 50% by mass.

A volume average particle diameter of the raw material mixed particles contained in the raw material mixed particle dispersion is preferably from 0.05 μm to 0.30 μm.

Hereinafter, the aggregating step (ACT102) will be described.

In the aggregating step (ACT102), the raw material mixed particle dispersion is stirred while being heated. As a result, the raw material mixed particles dispersed in the raw material mixed particle dispersion are aggregated to each other, and an aggregate dispersion is prepared. The crystalline polyester resin is subjected to the cross linking through the cross-linking agent, and a cross-linked structure is formed as a result. In the toner in which the cross-linked structure is formed, the fixing properties at a low temperature are more significantly improved and a temperature range for fixing is likely to be widened. In addition, the storage stability of the toner is also improved.

A heating temperature for the raw material mixed particle dispersion is appropriately set. For example, the raw material mixed particle dispersion is preferably heated to 60° C. to 90° C.

A rate of temperature increase of the raw material mixed particle dispersion is preferably from 0.1° C./min to 1° C./min and more preferably from 0.2° C./min to 0.5° C./min, in order to aggregate the raw material mixed particles more densely.

When the raw material mixed particle dispersion is stirred, an arbitrary component may be added, if necessary. For example, as the arbitrary component, the aggregating agent is used, for example. A volume average particle diameter of the aggregate in the aggregate dispersion is preferably from 3 μm to 8 μm.

Hereinafter, the fusion step (ACT103) will be described.

In the fusion step (ACT103), the aggregate dispersion is heated after the aggregating step (ACT102). Through the fusion step, a solution (fused particle dispersion), in which fused raw material mixed particles forming the aggregate are dispersed, is prepared.

A heating temperature for the aggregate dispersion is appropriately set. For example, the heating temperature for the aggregate dispersion is preferably from a glass transition temperature of the binder resin to a temperature which is 20° C. higher than a melting point of the crystalline polyester resin. In addition, the heating temperature for the aggregate dispersion is preferably 3° C. higher than the heating temperature for the raw material mixed particle dispersion in the aggregating step (ACT102). The heating time is preferably from 0.5 hours to 10 hours.

Hereinafter, the washing step (ACT104) will be described.

The washing step (ACT104) is appropriately performed by a well-known washing method. The washing step is, for example, performed by repeating washing using ion exchange water and filtering. The washing step is preferably repeated until conductivity of a filtrate is equal to or smaller than 50 μS/cm.

Hereinafter, the drying step (ACT105) will be described.

The drying step (ACT105) is appropriately performed by a well-known method. The drying step is, for example, performed by a vacuum drying machine. The drying step is performed until water content of the fused particles is preferably equal to or smaller than 1.0% by mass.

Toner particles are prepared by performing the above-mentioned steps in ACT101 to ACT105. The prepared toner particles may be used as electrophotographic toner as they are.

The manufacturing method of the electrophotographic toner according to the second embodiment may include a step to add an external additive, after the toner particle preparation process.

Hereinafter, the step to add the external additive will be described.

In the step to add the external additive, the toner particles obtained after the drying step (ACT105) and an external additive are mixed with each other and a toner particles coated with the external additive is obtained.

A compounding amount of the external additive is preferably from 0.01 parts by mass to 10 parts by mass with respect to 100 parts by mass of the toner particles.

Examples of a mixing machine used when mixing the toner particles and the external additive include Henschel mixer (manufactured by Mitsui Mining Co., Ltd.), Super mixer (manufactured by Kawata Mfg. Co., Ltd.), Robocone (manufactured by Okawara Mfg. Co., Ltd.), Nauta mixer (manufactured by Hosokawa Micron, Co., Ltd.), Turbulizer (manufactured by Hosokawa Micron, Co., Ltd.), Cyclomixer (manufactured by Hosokawa Micron, Co., Ltd.), Spiral Pin Mixer (manufactured by Pacific Machinery & Engineering Co., Ltd.), and Lodige Mixer (manufactured by Matsubo Corporation).

The manufacturing method of the electrophotographic toner according to the second embodiment is a so-called chemical method. Through the chemical method, the electrophotographic toner of the first embodiment is stably manufactured, even when the content ratio of the crystalline polyester resin is high.

Third Embodiment

In a third embodiment, a manufacturing method of the electrophotographic toner according to the first embodiment, which is different from the one according to the second embodiment, is described.

The manufacturing method of the electrophotographic toner according to the present embodiment includes a toner particle preparation process of preparing toner particles containing the crystalline polyester resin.

The toner particle preparation process according to the embodiment includes an aggregating step, a cross linking promotion step, and a fusion step in this order. By performing the aggregating step, an aggregate containing the crystalline polyester resin and the cross-linking agent is obtained in an aqueous medium. By performing the cross linking promotion step, cross linking between the crystalline polyester resin and the cross-linking agent contained in the aggregate obtained in the aggregating step is promoted. By performing the fusion step, the aggregate subjected to the promoted cross linking is heated at an arbitrary temperature.

Hereinafter, the toner particle preparation process according to the third embodiment will be described with reference to the drawings.

Figure 2:
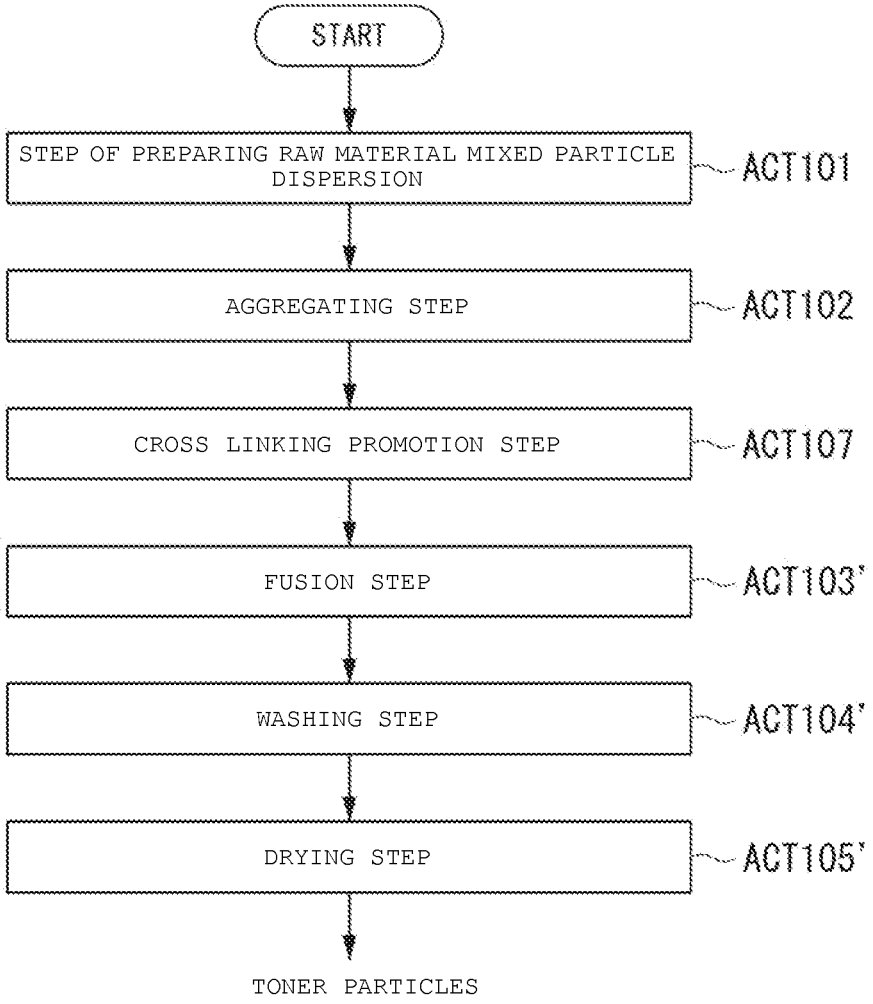
FIG. 2 is a flowchart of a toner particle preparation process according to another embodiment.

FIG. 2 is a flow chart of the toner particle preparation process according to the third embodiment. The toner particle preparation process according to the embodiment includes a step of preparing a raw material mixed particle dispersion (ACT101), an aggregating step (ACT102), a cross linking promotion step (ACT107), a fusion step (ACT103'), a washing step (ACT104'), and a drying step (ACT105').

The steps (ACT101, ACT102, ACT103', ACT104', and ACT105') except for the cross linking promotion step (ACT107) according to the third embodiment is the same as the steps (ACT101 to ACT105) according to the second embodiment described above.

Hereinafter, the cross linking promotion step (ACT107) will be described.

In the cross linking promotion step (ACT107), the aggregate dispersion prepared in the aggregating step (ACT102) is stirred while being heated. Through the cross linking promotion step, the cross linking with the crystalline polyester resin is promoted and the cross-linked structure is more densely formed. Since the cross-linked structure is more densely formed in the toner, a temperature range for fixing is more likely to be widened.

In the cross linking promotion step (ACT107), the cross-linking agent may be further added.

A heating temperature in the cross linking promotion step (ACT107) may be a temperature at which a reaction between the crystalline polyester resin and the cross-linking agent proceeds. The heating temperature in the cross linking promotion step (ACT107) is, for example, preferably equal to or higher than the heating temperature for the raw material mixed particle dispersion in the aggregating step (ACT102) and more preferably from 60° C. to 90° C. The heating time is preferably equal to or longer than 30 minutes and more preferably from 1 hour to 4 hours, in a viewpoint of cross linking promotion.

The toner particles are prepared by performing the steps of ACT101, ACT102, ACT107, ACT103', ACT104', and ACT105' described above. The prepared toner particles may be used as electrophotographic toner as they are.

The manufacturing method of the electrophotographic toner according to the third embodiment may include a step to add an external additive, after the toner particle preparation process. The description regarding the step to add the external additive is the same as the step to add the external additive according to the second embodiment described above.

The manufacturing method of the electrophotographic toner according to the third embodiment includes the cross linking promotion step (ACT107) between the aggregating step (ACT102) and the fusion step (ACT103'). According to the third embodiment, a toner having more significantly improved fixing properties at a low temperature, a further widened temperature range for fixing, and more significantly improved storage stability is manufactured.

Hereinafter, a manufacturing method of electrophotographic toner of another embodiment will be described.

As the manufacturing method of the other embodiment, a step different from the step (ACT101) of the second or third embodiment described above is used. The raw material mixed particle dispersion may be, for example, prepared by mixing each dispersion of crystalline polyester resin particles, amorphous polyester resin particles, colorant particles, and wax particles with each other.

The ph of the dispersion before the fusion step and after the aggregating step or the cross linking promotion step is preferably adjusted to be smaller than 7 and more preferably in a range of 5.0 to 6.5. Since the pH of the dispersion is adjusted to be smaller than 7, a lubricity of the surface of the finally obtained toner is likely to be higher. Meanwhile, when the pH of the dispersion is equal to or greater than the preferable lower limit value of the range described above, union of the particles is suppressed. The pH of the dispersion can be adjusted by acid such as nitric acid or sulfuric acid.

In addition, after the step to add the external additive, a sieving step may be performed for the toner particles coated with the external additive. Accordingly, coarse particles among the particles or foreign materials are removed. Examples of a device used in the sieving process include ULTRA SONIC (manufactured by Koei Sangyo Co., Ltd.), Gyro shifter (manufactured by Tokuju Corporation), VIBRASONIC SYSTEM (manufactured by Dalton Co., Ltd.), SONICLEAN (manufactured by Sinto Kogio, Ltd.), TURBO SCREENER (manufactured by Freund Turbo), MICRO SHIFTER (manufactured by Makino Mfg. Co., Ltd.), and a circular vibrating sieve.

Fourth Embodiment

A toner cartridge according to a fourth embodiment, contains the electrophotographic toner according to the first embodiment in a container. As the container, a well-known container can be used.

An image is formed at a lower fixation temperature, when the toner cartridge according to the embodiment is used in an image forming apparatus. In addition, high temperature offset resistance is improved and a temperature range for fixing is widened.

Fifth Embodiment

In an image forming apparatus according to the fifth embodiment, the electrophotographic toner according to the first embodiment is contained in an apparatus main body. A general electrophotographic device can be used for the apparatus main body.

Hereinafter, the image forming apparatus according to the embodiment will be described with reference to the drawings.

Figure 3:
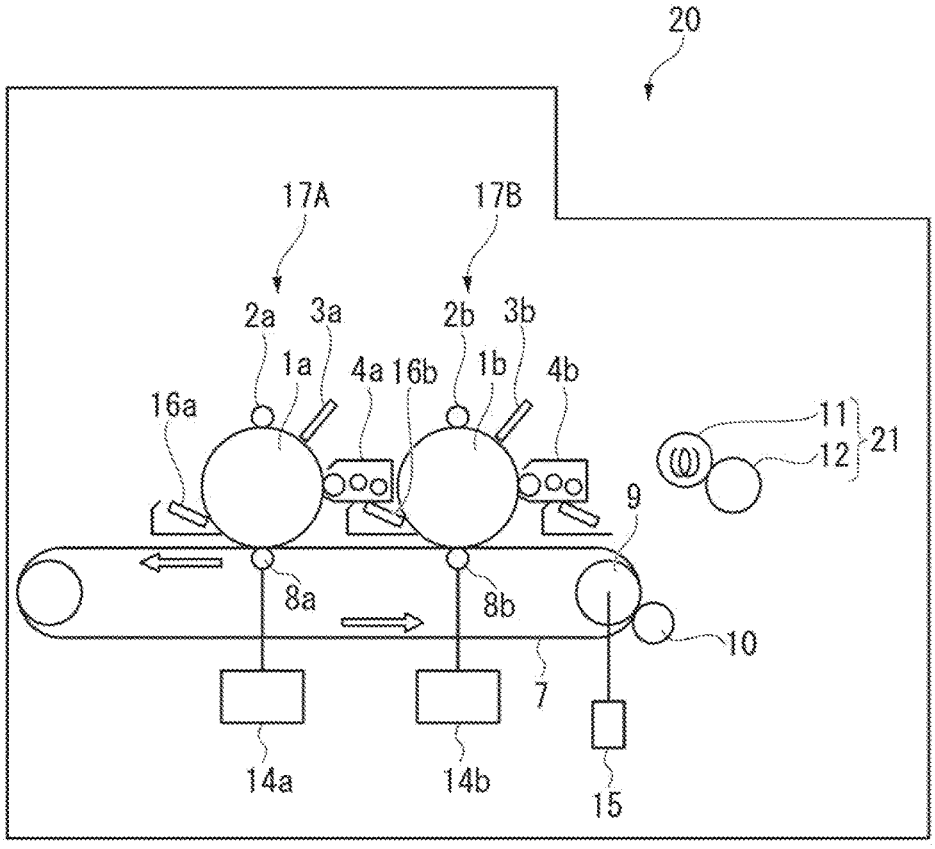
FIG. 3 illustrates an image forming apparatus according to one embodiment.

FIG. 3 is a schematic view of the image forming apparatus according to the embodiment.

As shown in the drawing, an image forming apparatus 20 includes an apparatus main body including an intermediate transfer belt 7, a first image forming unit 17A and a second image forming unit 17B provided on the intermediate transfer belt 7 in this order, and a fixing device 21 provided on the downstream thereof. The first image forming unit 17A is provided on the downstream of the second image forming unit 17B along a movement direction of the intermediate transfer belt 7, that is, along a proceeding direction of an image forming process. The fixing device 21 is provided on the downstream of the first image forming unit 17A.

The first image forming unit 17A includes a photoreceptor drum 1*a*, a cleaning device 16*a*, a charging device 2*a*, an exposing device 3*a*, and a first developing device 4*a* provided on the photoreceptor drum 1*a* in this order, and a primary transfer roller 8*a* which is provided so as to face the photoreceptor drum 1*a* with the intermediate transfer belt 7 disposed therebetween.

The second image forming unit 17B includes a photoreceptor drum 1*b*, a cleaning device 16*b*, a charging device 2*b*, an exposing device 3*b*, and a second developing device 4*b* provided on the photoreceptor drum 1*b* in this order, and a primary transfer roller 8*b* which is provided so as to face the photoreceptor drum 1*b* with the intermediate transfer belt 7 disposed therebetween.

The electrophotographic toner according to the first embodiment is contained in the first developing device 4*a* and the second developing device 4*b*. The electrophotographic toner may be supplied from a toner cartridge (not shown).

A primary transfer power source 14*a* is connected to the primary transfer roller 8*a*. A primary transfer power source 14*b* is connected to the primary transfer roller 8*b*.

A secondary transfer roller 9 and a back-up roller 10 are disposed so as to face each other across the intermediate transfer belt 7 on the downstream of the first image forming unit 17A. A secondary transfer power source 15 is connected to the secondary transfer roller 9.

The fixing device 21 includes a heating roller 11 and a pressing roller 12 disposed so as to face each other.

For example, the image forming is performed as follows using the image forming apparatus 20 of FIG. 3.

First, the photoreceptor drum 1*b* is uniformly charged by the charging device 2*b*.

The photoreceptor drum 1*b* is exposed by the exposing device 3*b* and an electrostatic latent image is formed. Then, the development is performed with the toner supplied from the developing device 4*b* and a second toner image is obtained.

The photoreceptor drum 1*a* is uniformly charged by the charging device 2*a*.

The exposure is performed by the exposing device 3*a* based on first image information (second toner image) and an electrostatic latent image is formed. Then, the development is performed with the toner supplied from the developing device 4*a* and a first toner image is obtained.

The second toner image and the first toner image are transferred onto the intermediate transfer belt 7 in this order using the primary transfer rollers 8*a* and 8*b*.

An image obtained by stacking the second toner image and the first toner image in this order on the intermediate transfer belt 7 is secondarily transferred onto a recording medium (not shown) through the secondary transfer roller 9 and the back-up roller 10. As a result, the image obtained by stacking the first toner image and the second toner image in this order is formed on the recording medium.

The kind of the colorant used in the toner in the developing device 4*a* and the developing device 4*b* is arbitrarily selected. The image forming apparatus 20 shown in the drawing includes two developing devices, but the image forming apparatus may include three or more developing devices depending on the kind of toner used.

According to the image forming apparatus according to the fifth embodiment, an image can be formed at a lower fixation temperature. In addition, high temperature offset resistance is improved and a temperature range for fixing is widened.

According to at least one embodiment described above, an electrophotographic toner which has a high content ratio of the crystalline polyester resin and satisfies a relationship of the following expression (1) when the toner is tested using the flow tester measurement.

$$0.3 \leq (\text{4 mm fall temperature} - \text{2 mm fall temperature}) / (\text{2 mm fall temperature} - \text{outflow start temperature}) \leq 1 \quad \text{Expression (1)}$$

When an image is formed by the electrophotographic toner according to the embodiment, the toner is likely to be fixed at a further lower temperature. In addition, high temperature offset resistance is improved and a temperature range for fixing is likely to be widened. Further, in the electrophotographic toner according to the embodiment, excellent blocking resistance and storage stability are likely to be obtained.

The following examples are for describing an example of the embodiment. However, the present disclosure is not interpreted to be limited to the examples.

Hereinafter, the measurement using the flow tester will be described.

1.45 g of the toner of each example was added into a granulator and pressurized with 1,000 kgf (9806.65 N) for 1 minute, and a pellet-like sample was obtained.

The obtained sample was added into a flow tester (capillary rheometer) CFT-500D manufactured by Shimadzu Corporation, and the outflow start temperature ($T_0$), the 2 mm fall temperature ($T_{2\ mm}$), and the 4 mm fall temperature ($T_{4\ mm}$) were respectively measured under the following measurement conditions.

Measurement Conditions

Preheating time: 300 seconds

Start temperature: 40° C.

Reaching temperature: 200° C.

Rate of temperature increase: 2.5° C./min

Load by plunger: 10 kg

Die hole diameter: 1.0 mm

Die length: 1.0 mm

From the measurement results, the ratio represented as $(T_{4\ mm}-T_{2\ mm})/(T_{2\ mm}-T_0)$ was calculated.

Hereinafter, an evaluation of the fixation temperature of the toner will be described.

The toner of each example and a ferrite carrier coated with straight silicone were mixed with each other and a developer was prepared. At that time, the concentration of the ferrite carrier in the developer is set so that toner ratio concentration is 8% by mass.

The toner cartridge containing the developer was disposed in an electrophotographic multifunction machine (MFP e-STUDIO 5055C) manufactured by Toshiba Tec Corporation having a variable fixation temperature and the image forming was performed. At that time, the image forming was performed while changing the setting of the fixation temperature, and a lowest fixation temperature, a highest fixation temperature, and a temperature range for fixing were respectively acquired.

In order to perform the fixing with low power, it is desirable that the lowest fixation temperature is low and the lowest fixation temperature is preferably equal to or lower than 110° C. When considering a temperature change of a fixing device, it is desirable that the temperature range for fixing is wide, and the temperature range for fixing is preferably equal to or higher than 40° C.

Hereinafter, an evaluation of glossiness of an image will be described.

In the evaluation of the fixation temperature of the toner described above, fixed images were output by setting temperature for every 5° C. of the temperature from the lowest fixation temperature to the highest fixation temperature as the fixation temperatures and the glossiness of each image was measured using a gloss meter. A maximum value among the measured glossiness values was set as glossiness of the image.

In a case of a color image, the glossiness of the image is preferably equal to or greater than 5, in order to ensure an excellent color reproduction area.

Hereinafter, an evaluation of the storage stability of the toner will be described.

A plastic container containing the toner of each example was stored in a thermostat. After setting the temperature in the thermostat as 50° C., the temperature was increased 1° C. at a time and a temperature for the start of the solidification of the toner was measured.

Since the toner is hardly solidified and a lump is hardly formed with the increase in temperature, the upper limit temperature for stable storage is preferably equal to or higher than 56° C. (a toner which is not solidified even when the temperature is increased to be equal to or higher than 56° C. is preferable).

Hereinafter, the manufacturing method of the toner will be described.

Example 1

Hereinafter, the toner particle preparation process will be described.

15 parts by mass of the amorphous polyester resin (glass transition temperature of 56° C.) and 75 parts by mass of the crystalline polyester resin (melting point 70° C.) as the binder resin, 5 parts by mass of the cyan pigment as the colorant, and 5 parts by mass of the carnauba wax as the wax were mixed with each other using the Henschel mixer, and a raw material mixture was obtained.

30 parts by mass of the obtained raw material mixture, 2 parts by mass of an anionic surfactant (NeoPelex 65), 1 part by mass of an amine compound (dimethyl aminoethanol), and 67 parts by mass of ion exchange water were added in CLEARMIX and heated. After the temperature of the sample reached 90° C., a rotation rate of the CLEARMIX was set at 12000 rpm and the mixture was stirred for 30 minutes. The mixture was cooled to a normal temperature (20° C.) and a raw material mixed particle dispersion was obtained (step of preparing the raw material mixed particle dispersion).

The volume average particle diameter of the raw material mixed particles in the obtained raw material mixed particle dispersion was measured using SALD7000 (manufactured by Shimadzu Corporation) and was 0.12 μm.

56.8 parts by mass of the obtained raw material mixed particle dispersion and 3.2 parts by mass of EPOCROS WS-700 (manufactured by Nippon Shokubai Co., Ltd.) as the cross-linking agent were added in a flask and stirred at 25° C. for 15 minutes. 90 parts by mass of a 10 mass % aqueous ammonium sulfate solution was dropped and stirred while heating to 72° C. for 120 minutes, and an aggregate particle dispersion was obtained (aggregating step).

A volume average particle diameter of the aggregate particles in the obtained aggregate particle dispersion was measured using the coulter counter and was 6.2 μm.

The mixture was further stirred at 72° C. for 120 minutes, in order to promote the cross linking (cross linking promotion step).

3 parts by mass of the anionic surfactant (NeoPelex 65) and 10 parts by mass of 0.3 mass % aqueous nitric acid solution were added to the aggregated particle dispersion subjected to the cross linking promotion, heated and fused to 80° C. for 120 minutes, and a fused particle dispersion was obtained (fusion step).

The obtained fused particle dispersion was cooled, Buchner filtering and then washing were performed (washing step).

The filtrate was dried by a vacuum drying machine until water content is equal to or smaller than 1% by mass to thereby obtain toner particles (drying step).

A volume average particle diameter of the obtained toner particles was measured by the coulter counter and was 6.6 μm.

Hereinafter, the step to add the external additive will be described.

2 parts by mass of silica (NAX50) subjected to hydrophobizing process was added to 100 parts by mass of the obtained toner particles, the components were mixed using the Henschel mixer, and then a toner was obtained.

A volume average particle diameter of the finally obtained toner was measured by the coulter counter and was 6.6 μm.

Examples 2 to 7

A toner was obtained in the same manner as in Example 1, except for changing the amount of the amorphous polyester resin, the amount of the crystalline polyester resin, the amount of the cross-linking agent, and the stirring time at 72° C. in the cross linking promotion step to the values as shown in FIG. 4.

Volume average particle diameters of the obtained toner of each example were measured by the coulter counter and were from 6.0 μm to 7.0 μm.

Comparative Example 1

A toner was obtained in the same manner as in Example 1, except for not combining the cross-linking agent. A volume average particle diameter of the obtained toner was measured by the coulter counter and was 7.6 μm.

Comparative Example 2

A toner was obtained in the same manner as in Example 1, except for changing the amount of the amorphous polyester resin and the amount of the crystalline polyester resin to the values as shown in FIG. 4. A volume average particle diameter of the obtained toner was measured by the coulter counter and was 6.0 μm.

Comparative Example 3

A toner was obtained in the same manner as in Example 1, except for not performing the cross linking promotion step (stirring at 72° C.). A volume average particle diameter of the obtained toner was measured by the coulter counter and was 6.4 μm.

FIG. 4 shows the toner composition of each example and results of the evaluations regarding the toner of each example.

In the toners of Comparative Example 1 and Comparative Example 3 which do not satisfy the relationship of the expression (1), the temperature range for fixing were narrow for each of the comparative examples.

In the toner of Comparative Example 2 having the incorporated amount of the crystalline polyester resin of less than 25% by mass, the lowest fixation temperature was relatively high. In addition, in the toner of Comparative Example 2, the evaluation of the storage stability was bad.

Meanwhile, with all of the toners of Examples 1 to 7 employing the embodiments, excellent fixing properties at a low temperature were obtained, the temperature range for fixing was wide, and excellent storage stability was obtained.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A toner, comprising a plurality of aggregated particles including:

a cross-linked crystalline polyester binder resin in an amount equal to or greater than 25% by mass with respect to the entire toner; and a colorant aggregated with the cross-linked crystalline polyester binder resin, wherein the toner satisfies the following formula when the toner is tested using a capillary rheometry measurement during which a pellet of the toner is pressed by a member while being heated:

$$0.3 \leq (\text{first temperature} - \text{second temperature})/(\text{second temperature} - \text{third temperature}) \leq 1, \text{ where}$$

the first temperature is a temperature at which the member falls 4 mm, the second temperature is a temperature at which the member falls 2 mm, and the third temperature is a temperature at which the member starts to fall.

2. The toner according to claim 1, wherein the first temperature is equal to or greater than 75° C. and equal to or smaller than 150° C.

3. The toner according to claim 1, wherein the second temperature is equal to or greater than 70° C. and equal to or smaller than 120° C.

4. The toner according to claim 1, wherein the third temperature is equal to or greater than 60° C. and equal to or smaller than 80° C.

5. The toner according to claim 1, wherein the aggregated particles further include a non-crystalline polyester binder resin, and a ratio of the cross-linked crystalline polyester binder resin to the non-crystalline polyester binder resin is greater than 0.3 and smaller than 8.0.

6. The toner according to claim 1, wherein a difference between the first temperature and the second temperature is equal to or greater than 5° C. and equal to or smaller than 35° C.

7. The toner according to claim 1, wherein a difference between the second temperature and the third temperature is equal to or greater than 10° C. and equal to or smaller than 40° C.

8. A toner cartridge comprising:

a container; and a toner contained in the container, wherein the toner comprises a plurality of aggregated particles containing a cross-linked crystalline polyester binder resin in an amount equal to or greater than 25% by mass with respect to the entire toner, and a colorant aggregated with the cross-linked crystalline polyester binder resin, and the toner satisfies the following formula when the toner is tested using a capillary rheometry measurement during which a pellet of the toner is pressed by a member while being heated:

$$0.3 \leq (\text{first temperature} - \text{second temperature})/(\text{second temperature} - \text{third temperature}) \leq 1, \text{ where}$$

the first temperature is a temperature at which the member falls 4 mm, the second temperature is a temperature at which the member falls 2 mm, and the third temperature is a temperature at which the member starts to fall.

9. The toner cartridge according to claim 8, wherein the first temperature is equal to or greater than 75° C. and equal to or smaller than 150° C.

10. The toner cartridge according to claim 9, wherein the second temperature is equal to or greater than 70° C. and equal to or smaller than 120° C.

11. The toner cartridge according to claim 9, wherein the aggregated particles further contains a non-crystalline polyester binder resin, and a ratio of the cross-linked crystalline polyester binder resin to the non-crystalline polyester binder resin is greater than 0.3 and smaller than 8.0.

12. The toner cartridge according to claim 9, wherein a difference between the first temperature and the second temperature is equal to or greater than 5° C. and equal to or smaller than 35° C.

13. The toner cartridge according to claim 9, wherein a difference between the second temperature and the third temperature is equal to or greater than 10° C. and equal to or smaller than 40° C.

14. The toner cartridge according to claim 10, wherein the third temperature is equal to or greater than 60° C. and equal to or smaller than 80° C.

15. A method for manufacturing a toner, comprising:

adding a crystalline polyester binder resin and a colorant into a medium;

aggregating particles of the crystalline polymer binder resin and a colorant by heat;

cross-linking the crystalline polyester binder resin and a cross-linking agent added into the medium;

causing fusion of the aggregated particles of the cross-linked crystalline polymer binder resin at a temperature that is higher than a temperature at which the particles of the crystalline polymer binder resin are aggregated; and extracting a toner containing the cross-linked crystalline polyester binder resin from the medium, wherein the toner satisfies the following formula when the toner is tested using a capillary rheometry measurement during which a pellet of the toner is pressed by a member while being heated:

$$0.3 \leq (\text{first temperature} - \text{second temperature})/(\text{second temperature} - \text{third temperature}) \leq 1, \text{ where}$$

the first temperature is a temperature at which the member falls 4 mm, the second temperature is a temperature at which the member falls 2 mm, and the third temperature is a temperature at which the member starts to fall.

16. The method according to claim 15, wherein the toner is extracted by causing the medium to be evaporated.

* * * * *